US009149818B1

(12) United States Patent
Orr

(10) Patent No.: US 9,149,818 B1
(45) Date of Patent: Oct. 6, 2015

(54) ATTIC SPRINKLER

(71) Applicant: The Viking Corporation, Hastings, MI (US)

(72) Inventor: Shawn G. Orr, Grand Rapids, MI (US)

(73) Assignee: THE VIKING CORPORATION, Hastings, MI (US)

( * ) Notice: Subject to any disclaimer, the term of this patent is extended or adjusted under 35 U.S.C. 154(b) by 0 days.

(21) Appl. No.: 14/477,489

(22) Filed: Sep. 4, 2014

(51) Int. Cl.

| | |
|---|---|
| ***A62C 31/02*** | (2006.01) |
| ***A62C 37/11*** | (2006.01) |
| ***A62C 37/14*** | (2006.01) |
| ***B05B 1/26*** | (2006.01) |
| ***A62C 35/68*** | (2006.01) |

(52) U.S. Cl.
CPC ..... *B05B 1/267* (2013.01); *A62C 35/68* (2013.01); *A62C 31/02* (2013.01); *A62C 37/11* (2013.01)

(58) Field of Classification Search
CPC ..... A62C 31/02; A62C 37/11; A62C 37/12; A62C 37/14; A62C 37/16; B05B 1/26; B05B 1/262; B05B 1/265; B05B 1/267
USPC ..... 169/37, 41, 57, 58; 239/505, 509, 510, 239/512, 518, 521, 523, 524
See application file for complete search history.

(56) References Cited

U.S. PATENT DOCUMENTS

| | | | | | |
|---|---|---|---|---|---|
| 720,013 | A | | 2/1903 | Esty | |
| 1,211,834 | A | | 1/1917 | Esty | |
| 1,288,123 | A | * | 12/1918 | Mowry | 239/504 |
| 2,378,273 | A | | 6/1945 | Wilhelm | |
| 2,697,008 | A | | 12/1954 | Rowley | |
| 3,051,397 | A | | 8/1962 | Hanson | |
| 3,178,119 | A | * | 4/1965 | Thorson | 239/570 |
| 3,911,940 | A | | 10/1975 | Johnson | |
| 4,405,018 | A | | 9/1983 | Fischer | |
| 4,580,729 | A | * | 4/1986 | Pounder | 239/524 |
| 4,585,069 | A | | 4/1986 | Whitaker | |
| 5,669,449 | A | | 9/1997 | Polan et al. | |
| 5,722,599 | A | | 3/1998 | Fries | |
| 7,331,399 | B2 | | 2/2008 | Multer | |
| 8,602,118 | B2 | | 12/2013 | Pigeon | |
| 2013/0043050 | A1 | | 2/2013 | Barmoav et al. | |

* cited by examiner

*Primary Examiner* — Darren W Gorman
(74) *Attorney, Agent, or Firm* — Harness, Dickey & Pierce, P.L.C.

(57) ABSTRACT

A fire protection sprinkler including a sprinkler frame including a body defining a passage therethrough with an inlet opening and an outlet opening, a pair of frame arms extend from the body and support a deflector boss having a pair of concave arcuate sidewalls that join to form a pointed edge proximal the outlet opening. The arcuate sidewalls taper laterally away from a reference plane in a distal direction from the outlet opening.

22 Claims, 4 Drawing Sheets

ATTIC SPRINKLER

FIELD

The present disclosure relates to an attic sprinkler and more particularly, to a sprinkler that is capable of providing a water spray pattern in two distinct directions.

BACKGROUND

This section provides background information related to the present disclosure which is not necessarily prior art.

Fire protection sprinklers are commonly designed for specific applications. One type of specific application includes the design of fire protection sprinklers for use with sloped ceilings and more particularly, attic sprinklers are designed for use under a peak of two adjoining pitched roof portions and between two opposing joists. With these types of attic sprinklers, it is desirable to provide a water spray pattern that sprays in two distinct directions.

SUMMARY

This section provides a general summary of the disclosure, and is not a comprehensive disclosure of its full scope or all of its features.

A fire protection sprinkler is provided including a sprinkler frame including a body defining a passage therethrough with an inlet opening and an outlet opening. A pair of frame arms extend from the body in a reference plane and a deflector boss is provided between the frame arms and having a pair of concave arcuate sidewalls that join to form a pointed edge proximal the outlet opening within the reference plane. The arcuate sidewalls taper laterally away from the reference plane in a distal direction from the outlet opening.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
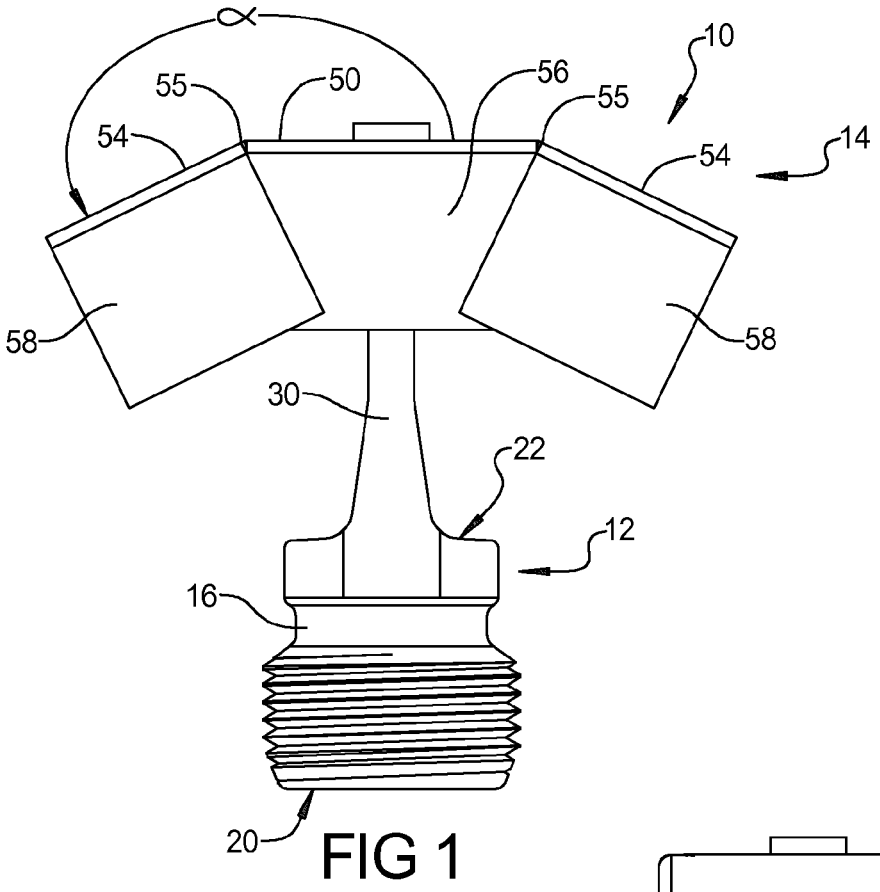
FIG. 1 is a side plan view of an attic sprinkler according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an attic sprinkler 10 according to the principles of the present disclosure will now be described. The attic sprinkler 10 includes a sprinkler frame 12 and a deflector 14 mounted to the sprinkler frame 12. The sprinkler frame 12 includes a body 16 having a passage 18 therethrough with an inlet opening 20 and an outlet opening 22. A plug 24 is supported in the outlet opening 22 of the passage 18 by a heat responsive trigger 26 that can include a glass bulb or soldered linkage-type trigger.

Figure 2:
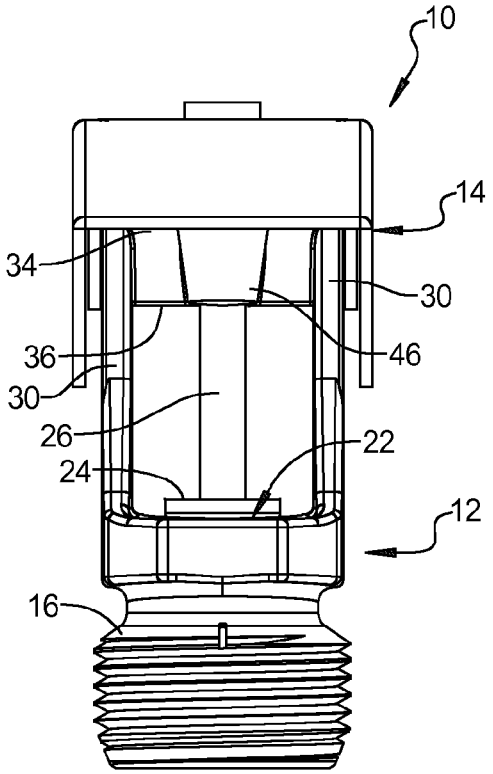
FIG. 2 is an end plan view of the attic sprinkler shown in FIG. 1.
Figure 3:
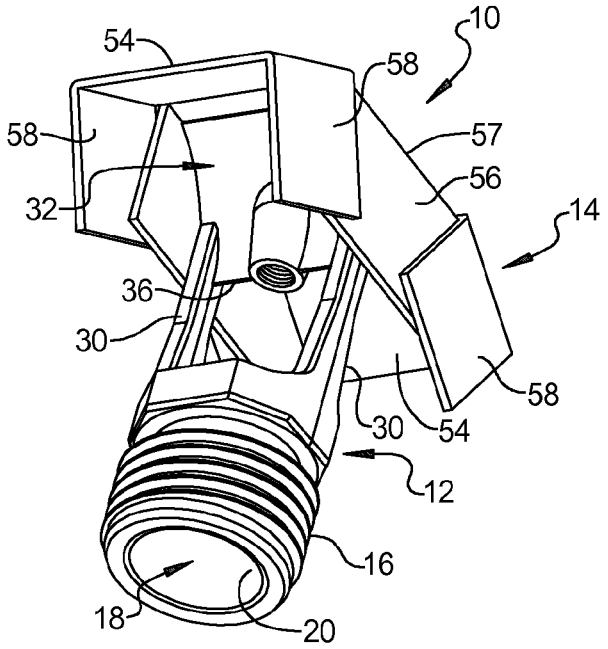
FIG. 3 is a perspective view of the attic sprinkler shown in FIG. 1.
Figure 4:
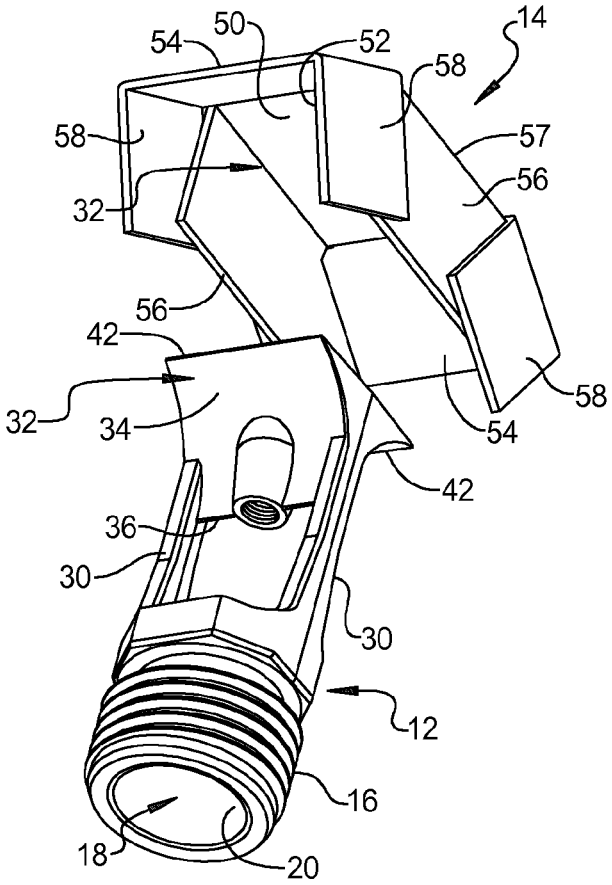
FIG. 4 is an exploded perspective view of the attic sprinkler with the deflector removed for illustration purposes.
Figure 5:
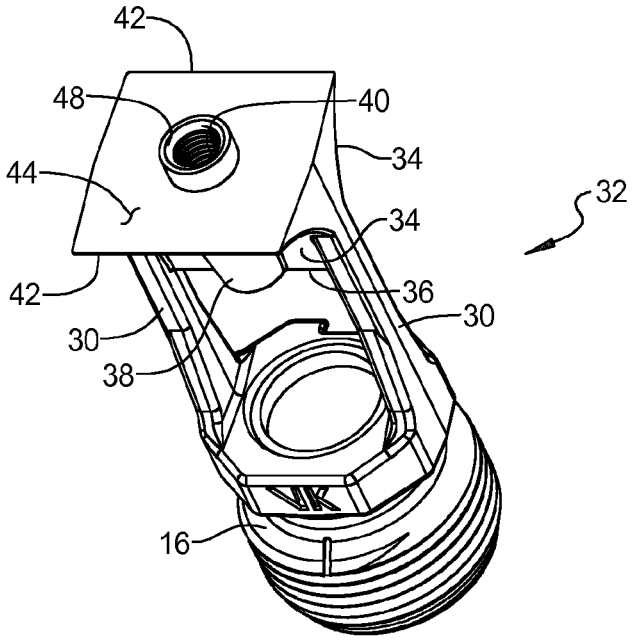
FIG. 5 is a perspective view of the sprinkler frame drawn to scale according to the principles of the present disclosure.
Figure 6:
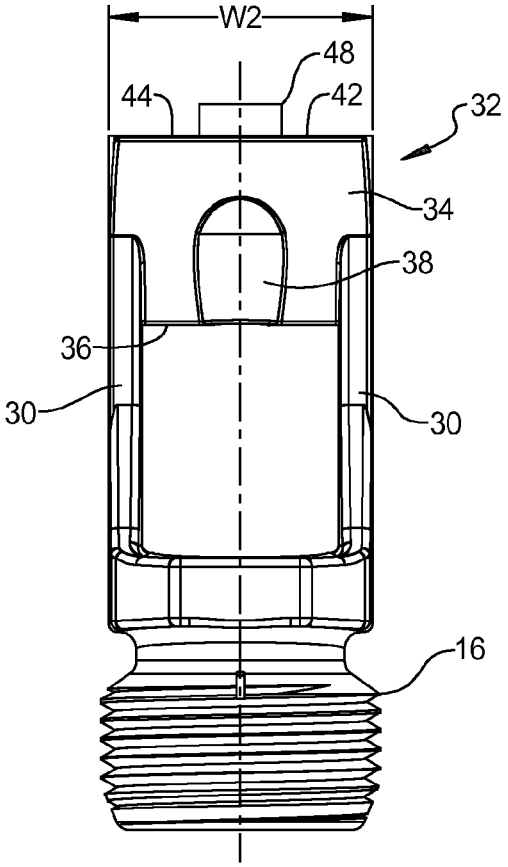
FIG. 6 is an end plan view drawn to scale of the sprinkler frame shown in FIG. 5.
Figure 7:
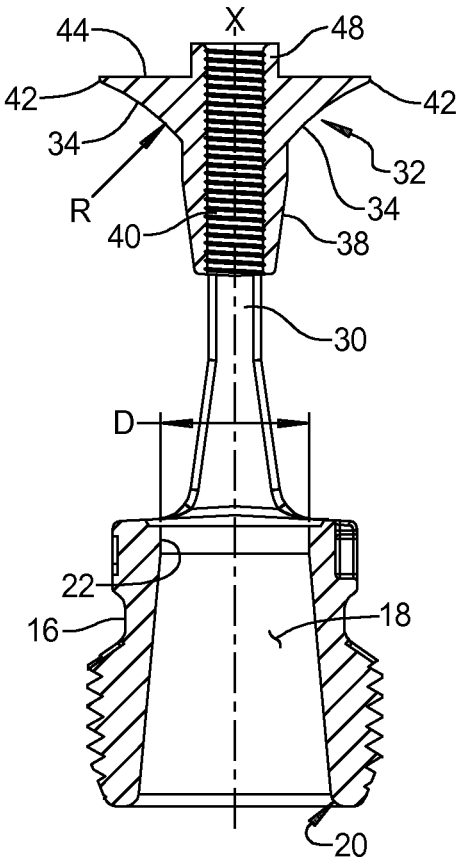
FIG. 7 is a cross-sectional view drawn to scale of the sprinkler frame taken along line 7-7 shown in FIG. 6.
Figure 8:
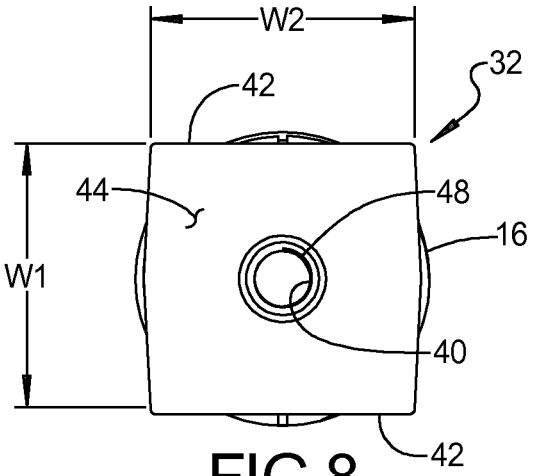
FIG. 8 is a top plan view drawn to scale of the sprinkler frame shown in FIG. 5.

As shown in FIG. 2, the sprinkler frame 12 includes a pair of frame arms 30 extending from the body 16 and a uniquely shaped deflector boss 32 extending between the frame arms 30. The frame arms 30 can be generally parallel to one another along their entire length with the deflector boss 32 extending the entire distance between the parallel frame arms 30. The deflector boss 32 can include a pair of concave generally arcuate shaped sidewalls 34 that join to form a pointed edge 36 at a proximal end to the outlet opening 22. The pointed edge 36 extends laterally along a reference plane X extending through a center of the frame arms 30 and is interrupted by a central boss portion 38 having a threaded opening 40 extending therethrough. Accordingly, the pointed edge 36 extends on opposite sides of the central boss portion 38 laterally outward to each of the frame arms 30 within the reference plane X. The arcuate shaped sidewalls 34 taper laterally away from the pointed edge 36 in a distal direction from the outlet opening. The arcuate shaped sidewalls 34 can terminate at a distal end that defines a pair of generally straight lateral edges 42 of the deflector boss 32. The pair of lateral edges 42 can define a generally straight edge that is disposed against the deflector 14. The deflector boss 32 can include a generally planar distal surface 44 that extends between the pair of lateral edges 42. The central boss portion 38 can extend from the distal surface 44 to provide a central mounting boss 48 for the deflector 14. A set screw 46 can be received in the threaded opening 40 of the central boss portion 38 for providing a load on the heat responsive trigger 26.

The deflector boss 32 has a width w1 along the reference plane X and a width w2 perpendicular to the reference plane X that is larger than a diameter D of the outlet opening. In particular, the width w1 and the width w2 can be between 1.5 and 2 times larger than the diameter D of the outlet opening and more particularly at least 1.8 times the diameter D. The width w1 and the width w2 can also be approximately equal to a distance from an outboard surface of one of the frame arms 30 to an outboard surface of the other frame arm 30. The arcuate shaped sidewalls 34 can have a radius of curvature R that is larger than the diameter D of the outlet opening 22 and smaller than the widths w1 and w2 of the deflector boss 32.

The deflector 14 can include a generally planar central portion 50 having an aperture 52 for receiving the central mounting boss 48. The central mounting boss 48 can be swaged to secure the deflector 14 to the central mounting boss 48. The generally planar central portion 50 of the deflector 14 can be rectangular or square in shape and have two opposing flaps 54 extending angularly from two edges 55 at a location generally parallel to the pair of lateral edges 42 of the deflector boss 32. The two opposing flaps 54 can extend at an angle $\alpha$ of between 100 and 135° and more particularly between 110 and 120° from the generally central portion 50. A pair of sidewalls 56 can extend from lateral edges 57 of the central portion 50 and generally perpendicular thereto and disposed directly adjacent to the frame arms 30. Each of the two opposing flaps 54 also include respective sidewalls 58 extending generally perpendicular thereto and in an overlapping relation on an exterior side of the pair of sidewalls 56. The pair of sidewalls 56 as well as the pairs of sidewalls 58 can be generally rectangular in shape or can have other polygonal shapes.

In operation, the sprinkler 10 is connected to a water distribution piping network (not shown) and the heat responsive trigger 26 secures the plug 24 in the outlet opening 22 of the frame body 16. During a fire, the heat from the fire causes the heat responsive trigger 26 to release the plug 24 from the outlet opening 22. As the water is discharge through the outlet opening 22, it impinges upon the deflector boss 32 where the pointed edge 36 of the arcuate shaped sidewalls 34 generally divides the flow of water into two equal streams that are redirected in two lateral directions along the arcuate shaped sidewalls 34. As the two equal streams engage the deflector 14, the two opposing flaps 54 direct the water flow in a downward angular direction while the sidewalls 56 and 58 of the deflector 14 maintain the direction of flow in the desired distinct flow directions.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fire protection sprinkler, comprising:

a sprinkler frame including a body defining a passage therethrough with an inlet opening and an outlet opening, a pair of frame arms extending from the body in a reference plane and a deflector boss having a pair of concave arcuate sidewalls that join to form a pointed edge proximal the outlet opening within the reference plane and that taper laterally away from the reference plane in a distal direction from the outlet opening; and a deflector mounted to the deflector boss.

2. The fire protection sprinkler according to claim 1, wherein said deflector boss includes a central boss portion interrupting said pointed edge and having a threaded opening extending therethrough.

3. The fire protection sprinkler according to claim 1, wherein said pair of concave arcuate sidewalls have a radius of curvature that is larger than a diameter of the outlet opening.

4. The fire protection sprinkler according to claim 1, wherein said deflector boss has a width in the reference plane that is wider than a diameter of the outlet opening.

5. The fire protection sprinkler according to claim 1, wherein said deflector boss has a width perpendicular to the reference plane that is wider than a diameter of the outlet opening.

6. The fire protection sprinkler according to claim 1, wherein said pair of frame arms are generally parallel to one another along their entire length.

7. The fire protection sprinkler according to claim 6, wherein said pair of arcuate sidewalls of said deflector boss extend an entire distance between the parallel frame arms.

8. The fire protection sprinkler according to claim 1, wherein said pair of concave arcuate sidewalls terminate at a distal end that define a pair of lateral edges of the deflector boss.

9. The fire protection sprinkler according to claim 8, wherein said lateral edges of the deflector boss are generally straight.

10. The fire protection sprinkler according to claim 9, wherein said deflector boss includes a generally planar surface between said lateral edges.

11. The fire protection sprinkler according to claim 10, wherein said deflector boss includes a central mounting boss extending from the generally planar surface, said central mounting boss being received in an aperture in said deflector.

12. The fire protection sprinkler according to claim 1, wherein said deflector includes a central portion including a pair of opposite edges and having a pair of opposing flaps extending from the pair of opposite edges at an angle of between 100 and 135°.

13. The fire protection sprinkler according to claim 12, wherein said deflector includes a pair of side walls extending generally perpendicular to said central portion.

14. The fire protection sprinkler according to claim 13, wherein said pair of opposing flaps each include a second and third pair of sidewalls, respectively, extending generally perpendicular to side edges of said flaps.

15. A fire protection sprinkler, comprising:

a sprinkler frame including a body defining a passage therethrough with an inlet opening and an outlet opening, a pair of frame arms extending from the body and generally parallel to one another along their entire length and a deflector boss having a pair of concave arcuate sidewalls extending an entire distance between the pair of frame arms; and a deflector mounted to the deflector boss.

16. The fire protection sprinkler according to claim 15, wherein said pair of concave arcuate sidewalls have a radius of curvature that is larger than a diameter of the outlet opening.

17. The fire protection sprinkler according to claim 15, wherein said deflector includes a central portion including a pair of opposite edges and having a pair of opposing flaps extending from the pair of opposite edges at an angle of between 100 and 135°.

18. The fire protection sprinkler according to claim 17, wherein said deflector includes a pair of side walls extending generally perpendicular to said central portion.

19. The fire protection sprinkler according to claim 18, wherein said pair of opposing flaps each include a second and third pair of sidewalls, respectively, extending generally perpendicular to side edges of said flaps.

20. The fire protection sprinkler according to claim 15, wherein said pair of concave arcuate sidewalls terminate at a distal end that define a pair of lateral edges of the deflector boss.

21. The fire protection sprinkler according to claim 20, wherein said lateral edges of the deflector boss are generally straight.

22. The fire protection sprinkler according to claim 21, wherein said deflector boss includes a generally planar surface between said lateral edges.

* * * * *